United States Patent [19]

Ascasibar-Verdejo

[11] 4,452,365

[45] Jun. 5, 1984

[54] CLOSURE DEVICE FOR HERMETICALLY SEALING CONTAINERS

[76] Inventor: Francisco Ascasibar-Verdejo, 8 Chopos St., Monteclaro-Madrid 23, Spain

[21] Appl. No.: 436,765

[22] Filed: Oct. 26, 1982

[30] Foreign Application Priority Data

Oct. 27, 1981 [ES] Spain ..... 261.067

[51] Int. Cl.[3] ..... B65D 41/22

[52] U.S. Cl. ..... 215/346

[58] Field of Search ..... 215/317, 318, 321, 346

[56] References Cited

U.S. PATENT DOCUMENTS 2,772,013 11/1956 Stover ..... 215/346 X
3,270,904 9/1966 Foster et al. ..... 215/345 X
3,344,943 10/1967 Zipper ..... 215/346
3,371,813 3/1968 Owen et al. ..... 215/346 X
4,227,616 10/1980 Lecinski et al. ..... 215/346 X
4,228,909 10/1980 Lecinski ..... 215/346 X

*Primary Examiner*—Donald F. Norton
*Attorney, Agent, or Firm*—Charles E. Brown

[57] ABSTRACT

A closure device for providing a seal with a container having a shallow external bead in the region of the mouth-defining rim of the container. The closure device comprises a central panel and a skirt joined by a sector forming an internal channel containing a molded plastic gasket. A portion of the gasket extending along an internal surface of the skirt is provided with a number of projections each having a shallow, rectangular, prismatic configuration. A lower portion of each projection is adapted to extend beyond the container bead to retain the closure device on the container.

2 Claims, 6 Drawing Figures

CLOSURE DEVICE FOR HERMETICALLY SEALING CONTAINERS

This invention relates to a closure device or lid of the type which is applied under pressure over the mouth of a container to provide a hermetic seal. Subsequent removal of the lid is accomplished by means of manual force, or with the aid of a tool which affords a slight lever action, and without the provision of a thread or similar elements for removal of the lid by means of rotation.

Closure devices or lids providing a hermetic seal are known for containers in which the container finish defining the mouth of the container has a helicoidal relief or thread and the lid is placed under pressure over the mouth. The lid comprises an upper panel, a perimetric skirt joined to the panel by means of an annular sector, arcuate in radial section, which forrms an internal channel about the panel, and a compressible molded gasket of plastic material which fills the channel and extends downwardly along the internal surface of the skirt so as to adapt itself, when applied under pressure over the mouth of the container, to the container thread to form a complementary groove in the material, which permits the lid to be removed by unthreading and to be replaced on the container as many times as are desired, until the contents of the container are entirely consumed. Just such a lid is disclosed in U.S. Pat. No. 3,270,904, issued Sept. 6, 1966 in the names of Charles N. Foster, Robert K. McElroy and John J. Curry, and assigned to Continental Can Company, Inc., now The Continental Group, Inc.

According to a known improvement, the inner surface of that portion of the molded gasket which extends along the internal surface of the skirt forms an angle with respect to the skirt and is provided with a plurality of ribs, each of which is formed in a diamond pattern and has a curved transverse section. This improvement is shown and described in U.S. Pat. No. 3,371,813, issued Mar. 5, 1968 in the names of Ronald C. Owen and Donald H. Zipper, and assigned to the aforesaid Continental Can Company, Inc.

More closely approaching the present invention is the closure device disclosed in U.S. Pat. No. 3,344,943, issued Oct. 3, 1967 in the name of Donald H. Zipper, and also assigned to the aforesaid Continental Can Company, Inc. Here the material of the gasket is formed with a series of lobes which engage the container finish inwardly of the closure skirt. The lobes are provided to prevent nesting of one closure within another and to alleviate entrapment of air or other ambient gas within the container during the closing operation. As will be understood from the ensuing description, the gasket configuration of the present invention performs a function which is not in any way contemplated or suggested in the prior patent.

Still more closely approaching the present invention is the closure device represented in FIGS. 5 and 6 of U.S. Pat. No. 4,227,616, issued Oct. 14, 1980 in the names of Frank H. Lecinski, Jr., and John N. Banich, Sr., and assigned to The Continental Group, Inc. The latter closure includes a number of lugs projecting inwardly from the gasket for retention purposes. However, unlike the projection of the present invention the lugs are elongated in the circumferential direction, are foreshortened in the vertical direction, and are of fusiform configuration. Further they are spaced from the principal gasket top-sealing portion.

The lid of the invention is applicable to containers such as bottles and jars having only a shallow exterior bead at the mouth-defining rim of the container or at a zone close to the rim. A helicoidal relief or thread is unnecessary.

For a purpose to be made clear in the ensuing description, the portion of the molded gasket which extends along the internal surface of the skirt is provided with a plurality of projections each having a generally rectangular prismatic configuration.

More particularly, the conformation of the present lid to the mouth-defining finish of bottles and jars, or of other types of container having similar mouths, is preferably obtained primarily by means of the vacuum applied to the package unit at the time the produce to be contained is packed, the novel configuration of the gasket being such as to admit of the lid again being applied to the container, using manual pressure, after the container has been opened to consume a portion of the product contained in it, to establish a seal which, though it will not have all the characteristics of the original seal established under vacuum, nevertheless ensures a precise fit of the lid on the container during the consumption phase.

The invention thus provides a seal for a container having the shape of a cylinder or an inverted truncated cone with a completely smooth mouth-defining finish except for a shallow external bead, at or near the rim, the seal permitting optimal adaptation of the lid to the finish and maintenance of said lid in the sealing position.

The lid is made up of a sheetlike body having a configuration in accordance with the mouth-defining finish of the container, and is provided with a depending perimetric skirt which is intended to adapt itself externally to the periphery of the mouth-defining finish.

Preferably the sheetlike body will be metallic and its perimetric skirt will be joined to the panel which constitutes its central portion by means of an annular sector which forms an internal channel between the skirt and the panel, the perimetric channel having a covering or gasket of plastic material which is extended to the skirt in such a way that the surfaces of the lid intended to come into contact with the container will be provided by the gasket.

In the described structure, it is a principal characteristic that the gasket portion adjacent to the perimetric skirt is provided with a number of internal projections, each having a rectangular prismatic configuration, the number varying as a function of the dimensions of each projection and the diameter of the lid, the projections being useful in the application of the lid to the container during vacuum sealing and constituting the means for retaining the lid on the container after it has been opened to begin consuming its contents.

As was previously stated, the container may be cylindrical or have the shape of an inverted truncated cone in the region of its mouth, the remainder of the container body being of any configuration, the container incorporating at or near the mouth a shallow external bead beyond which the aforementioned projections of the gasket will be partially extended in order to establish the anchoring desired.

The plastic compound which makes up the partial internal covering of the lid including the prismatic projections, is preferably hot-molded, and its adhesion to the lid is obtained in known manner by way of the characteristics of the compound itself as well as the characteristics of a bonding varnish applied on the substrate inner surface of the lid prior to shaping of the gasket.

IN THE DRAWINGS

Figure 1:
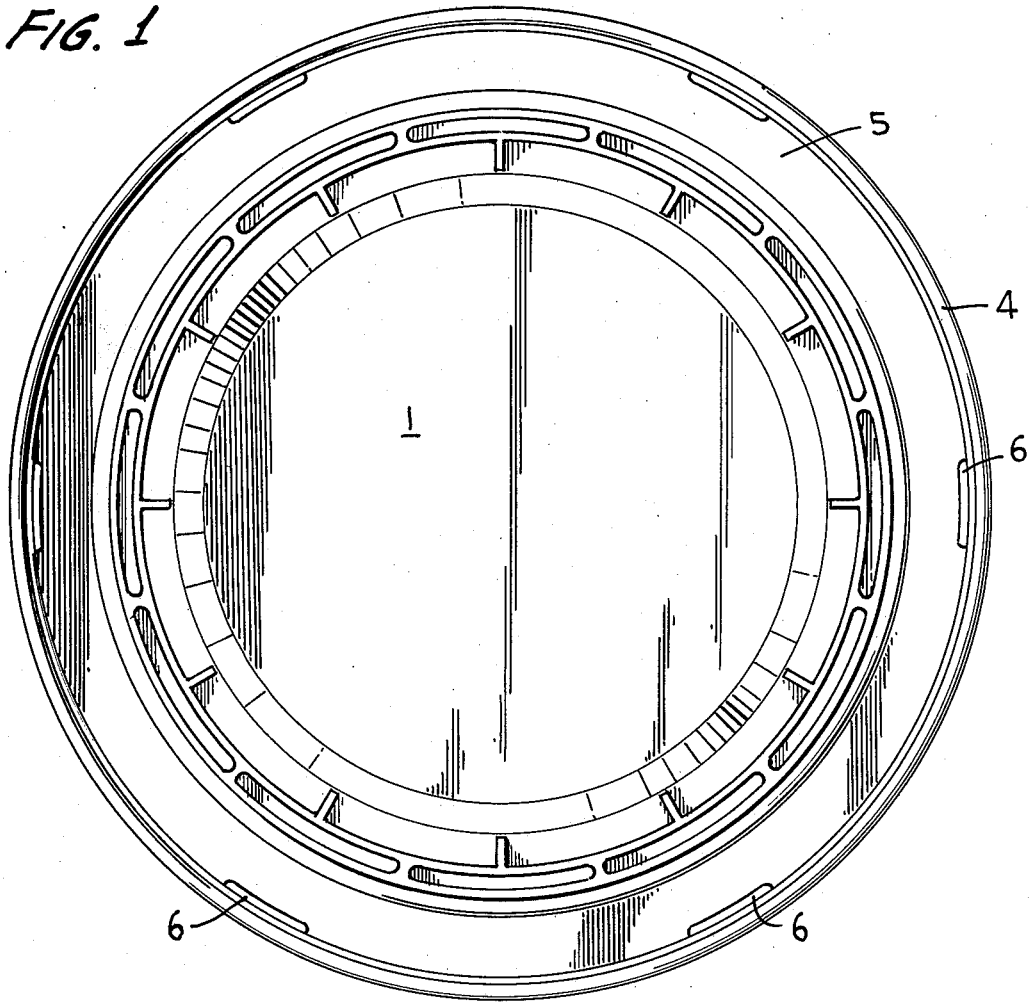
FIG. 1 is a plan view from below of a closure device or lid constructed in accordance with the present invention and showing the interior of the lid.
Figure 2:
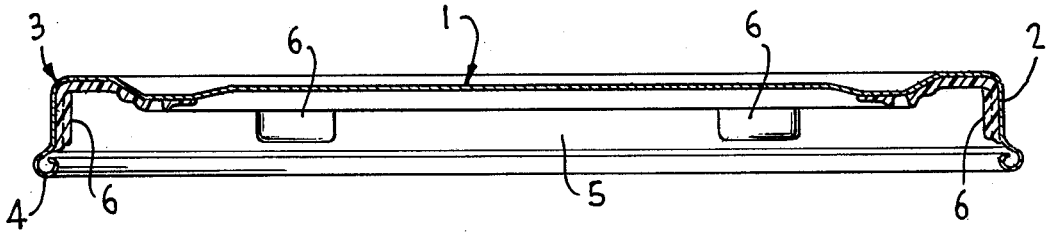
FIG. 2 is a diametric sectional view of the lid of FIG. 1.

From the drawings it will be seen the preferred lid according to the invention has a sheetlike body 1, preferably metallic, provided with a perimetric skirt 2 which is joined to a central portion 1' of the body by means of a markedly round or arcuate corner 3, the free edge of the skirt being suitably shaped to form a rolled edge 4 for strengthening purposes.

Both the perimetric skirt 2 and the rounded corner 3, which forms an internal channel, are provided with an interior covering or gasket 5 formed of plastic compound which, as was previously stated, is hot-molded on the metallic, sheetlike body.

The gasket 5 has a number of interior projections 6 in a zone corresponding to the skirt 2, each projection being of rectangular prismatic form. The width of each projection may vary, preferably between 8 and 15 mm, as a function of the number of projections, preferably between 6 and 12, and as a function of the diameter of the lid.

Figure 3:
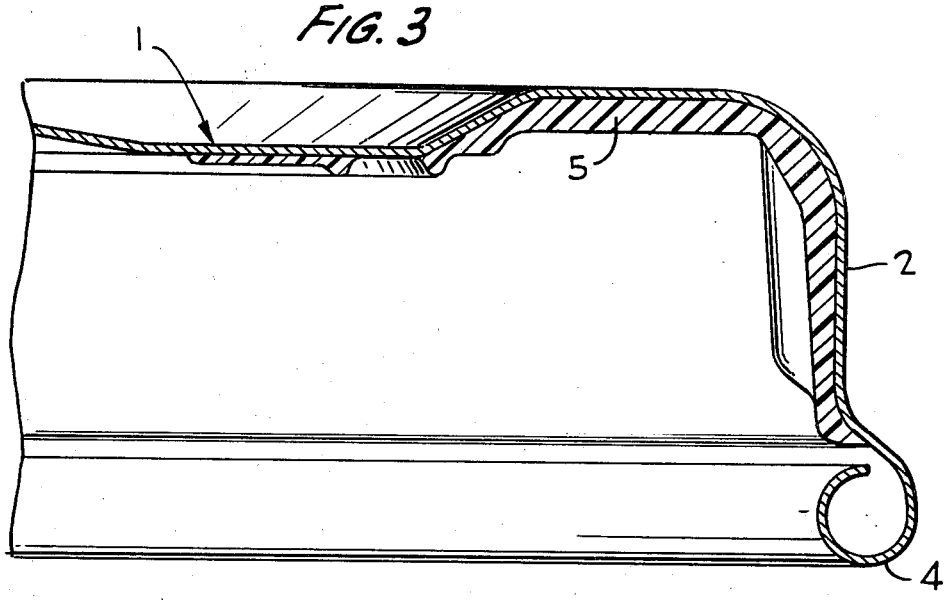
FIG. 3 is an enlarged partial sectional view of the lid of FIGS. 1 and 2.

The projections are formed from the same molded plastic compound as the remainder of the gasket and extend to the principal top-sealing portion of the gasket, as best seen in FIG. 3.

The projections 6 are relatively shallow in depth and preferably have rounded corners, whether the container to which the lid is to be applied is shaped as a truncated cone, represented in the drawings by numeral 7, or is cylindrical as represented at 8.

Figure 5:
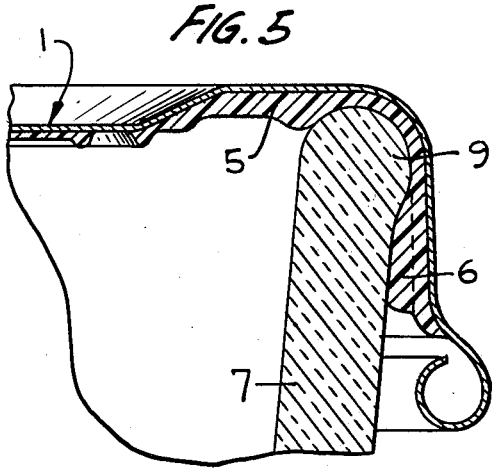
FIG. 5 is a partial sectional view showing the mating of the lid of FIGS. 1 to 4 to a container having the configuration of a truncated cone.
Figure 4:
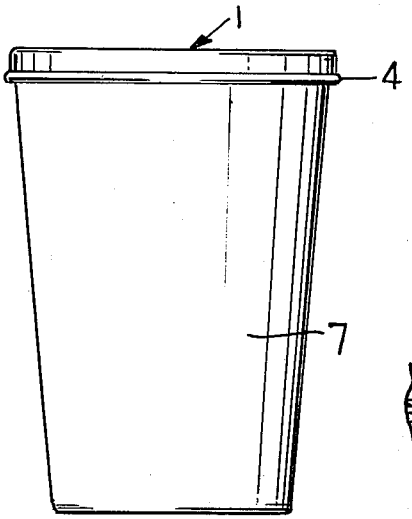
FIG. 4 is an elevational view of a container and the lid of FIGS. 1 to 3 in a sealed state.
Figure 6:
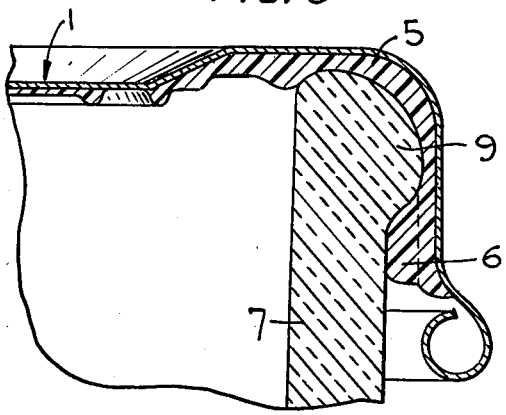
FIG. 6 is a view similar to that of FIG. 5 but showing a container having a cylindrical configuration.

In any case, the rim defining the mouth of the container 7,8 has a shallow external bead, as can be seen in FIGS. 5 and 6, whereby the projections 6 extend beyond the bead upon application of the lid to the container, as permitted by the elastic nature of the gasket material, so that the projections act as retaining elements.

Since the container is intended to be sealed under vacuum, the first opening of the container for consumption of its contents will be undertaken against the force established by the vacuum existing in the interior of the container and by the interengagement of the projections 6 and the external bead 9 of the mouth-defining rim of the container. When the container has once been opened, subsequent opening of the container will be undertaken only against the force established by the interengagement of the projections 6 and the bead 9, and a seal will be established by simple manual pressure.

Referring to FIGS. 5 and 6, it can be seen that, with suitable dimensions of the bead 9, the projections 6 will act against the lower surface of the bead in an elastic manner, establishing a permanent force exerted by the lid against the upper surface of the rim of the container. This ensures a seal which offers optimal watertightness.

While the invention has been particularly described in connection with a certain specific embodiment thereof, it is to be understood that this is by way of illustration and not of limitation, and that the scope of the appended claims should be construed as broadly as the prior art will permit.

What is claimed is:

1. In a closure device for providing a seal with a container having a shallow external bead in the region of the mouth-defining rim of the container, the closure device being of the type which comprises a panel, means defining a perimetric internal channel circumscribing the panel and forming a skirt beyond the channel, and a molding gasket formed of compressible plastic material reposing in the channel and extending along the internal surface of the skirt, the portion of the gasket extending along the internal surface of the skirt being provided with a plurality of internal projections, the improvement characterized by the features that each projection is separately formed integrally with said gasket with adjacent projections being circumferentially spaced from one another, that each projection has a shallow rectangular prismatic configuration, and that a lower portion of each of the projections being adapted to extend beyond the external bead on the container, whereby the closure device may be retained on the container in sealing relation therewith by the interengagement of the projections and the bead.

2. In a closure device according to claim 1, the further improvement characterized by the features that each of the gasket projections has a width of between 8 and 15 mm with the width varying as a function of the number of projections, and that the number of projections is between 6 and 12 with the number varying as a function of the diameter of the closure device.

* * * * *